US006955064B2

(12) United States Patent
Lee et al.

(10) Patent No.: US 6,955,064 B2
(45) **Date of Patent: *Oct. 18, 2005**

(54) MACHINE ROOM BACK COVER INTEGRATED WITH A CONDENSER FOR A REFRIGERATOR

(75) Inventors: Myung Ryul Lee, Seongnam-si (KR); Young Ju Ha, Busan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/345,361

(22) Filed: Jan. 16, 2003

(65) Prior Publication Data

US 2003/0221442 A1 Dec. 4, 2003

(30) Foreign Application Priority Data

May 20, 2002 (KR) ..... 10-2002-0027700

(51) Int. Cl.[7] ..... F25D 19/00
(52) U.S. Cl. ..... 62/453; 62/455; 62/444
(58) Field of Search ..... 62/453, 452, 454, 62/455, 444, 298

(56) References Cited

U.S. PATENT DOCUMENTS

| | | | | | |
|---|---|---|---|---|---|
| 2,180,472 | A | * | 11/1939 | Kucher | 62/453 |
| 2,237,007 | A | * | 4/1941 | Kucher | 62/452 |
| 2,666,302 | A | * | 1/1954 | Philipp | 62/295 |
| 2,669,853 | A | * | 2/1954 | Spiegelhalter | 62/453 |
| 3,153,919 | A | * | 10/1964 | Jernigan | 62/451 |
| 3,902,332 | A | * | 9/1975 | Torcomian | 62/451 |
| 5,228,311 | A | * | 7/1993 | Erdmann et al. | 62/389 |
| 5,502,983 | A | * | 4/1996 | Dasher | 62/454 |
| 5,881,567 | A | * | 3/1999 | Junge et al. | 62/428 |
| 6,029,471 | A | * | 2/2000 | Taylor | 62/453 |
| 6,244,067 | B1 | * | 6/2001 | Roth et al. | 62/457.9 |
| 6,718,793 | B2 | * | 4/2004 | Lee | 62/453 |

* cited by examiner

*Primary Examiner*—William C. Doerrler
(74) *Attorney, Agent, or Firm*—Fleshner & Kim, LLP

(57) ABSTRACT

Disclosed herein is a machine room back cover integrated with a condenser for a refrigerator, which is capable of protecting a machine room in which a compressor as one of elements constituting a refrigeration cycle is provided and serving as a heat emission plate by which coolant heat emitted from a condenser is dissipated outside the refrigerator by contacting with air introduced from the external of the machine room.

The present invention provides a back cover integrated with a condenser for a refrigerator, which is provided outside a machine room of the refrigerator, for protecting the machine room containing a compressor for pressurizing coolant evaporated into a low-temperature low-pressure gaseous state by an evaporator into a high-temperature high-pressure gaseous state and a condenser connected to the compressor for condensing the coolant pressurized by the compressor into a high-temperature high-pressure liquid state, wherein said condenser is formed in integral with an inner side of said back cover.

In addition, a heat area in which said condenser is contacted with air introduced from the external of said machine room is enlarged by increasing an area of said back cover integrated with said condenser so as to increase an amount of heat exchange of said condenser with the introduced air.

24 Claims, 7 Drawing Sheets

MACHINE ROOM BACK COVER INTEGRATED WITH A CONDENSER FOR A REFRIGERATOR

BACKGROUND OF THE INVENTION

1. Field of the Invention

The present invention relates generally to a refrigerator, and more particularly to a machine room back cover integrated with a condenser for a refrigerator, which is capable of protecting a machine room in which a compressor as one of elements constituting a refrigeration cycle is provided and serving as a heat emission plate by which coolant heat emitted from a condenser is dissipated outside the refrigerator by contacting with air introduced from the external of the machine room.

2. Description of the Related Art

Typically, a refrigerator is an apparatus for freezing or refrigerating food and drink by lowering temperature within the refrigerator by use of cold air generated through a refrigeration cycle constituted by a compressor, a condenser, an expansion valve and an evaporator.

FIG. 1 is a partial perspective view illustrating a structure of a machine room of a conventional refrigerator.

Referring to FIG. 1, a machine room 100 positioned in a rear bottom portion of the refrigerator contains a compressor 150 for pressurizing coolant evaporated into a low-temperature low-pressure gaseous state by the evaporator into a high-temperature high-pressure gaseous state, a condenser 120 connected to the compressor 150 for condensing the coolant pressurized by the compressor 150 into a room-temperature high-pressure liquid state, and a machine room back cover 110 for protecting the compressor 150 and the condenser 120.

FIG. 2 is a partial side sectional view of the refrigerator at which a conventional machine room back cover is fixed.

Referring to FIG. 2, the machine room back cover 110 for protecting the compressor 150 and the condenser 120 is fixed at the outside of the machine room 100 such that the compressor 150 and condenser 120 are isolated from air introduced from the external of the machine room 100.

As described above, since the conventional refrigerator incorporates the compressor 150 and the condenser 120 within the machine room 100, as shown in FIG. 1, the machine room 100 itself occupy most of a bottom portion of the refrigerator, and therefore, there is a problem that an inner space of the refrigerator cannot be utilized by the amount of space occupied by the machine room 100.

In addition, as shown in FIG. 2, since the machine room back cover 110 is fixed outside the machine room 100 such that the compressor and the condenser are isolated from air introduced from the external of the machine room so as not to make direct contact with each other, internal heat of the machine room 100 (i.e., waste heat generated by the temperature of the compressor itself raised by load of a motor (not shown) of the compressor 150 when the low-temperature low-pressure coolant is pressurized into the high-temperature high-pressure state, and coolant heat emitted around the condenser 120) and the like cannot be quickly emitted out of the machine room 100 through vents 140 of the back cover 110, resulting in the increase of internal temperature of the machines.

Further, the machine room back cover 110 itself cannot perform a function of a heat emission plate for emitting the coolant heat emitted around the condenser 120 out of the machine room 100 by heat convection phenomenon occurring when contacted with the air introduced from the external of the machine room 100. Accordingly, the coolant heat emitted around the condenser 120 cannot be smoothly emitted out of the machine room 100. This is another reason of the increase of the internal temperature of the machine room 100 as mentioned above.

SUMMARY OF THE INVENTION

Accordingly, the present invention has been made keeping in mind the above problems occurring in the prior art, and an object of the present invention is to protect a machine room in which a compressor is provided and provide a function of a heat emission plate by which coolant heat emitted from a condenser is dissipated outside the refrigerator by way of contact with air introduced from the external of the machine room, by integrally forming the condenser for condensing high-temperature high-pressure coolant introduced from the compressor on an inner side of a machine room back cover provided outside the machine room of the refrigerator.

Another object of the present invention is to enable repairs of the refrigerator without having to separate elements, which constitute a refrigeration cycle, including a condenser formed in integral with a machine room back cover from each other even when the machine room back cover is opened for repairs of the refrigerator, by forming a connection pipe for connecting the condenser to other elements so as to accomplish a complete refrigeration cycle as a creased pipe which can be randomly varied in its extension and direction.

Still another object of the present invention is to save space within a machine room by the space within which a condenser was conventionally provided and utilize the saved space as internal space of a refrigerator, by integrally forming the condenser conventionally connected to a compressor in the machine room on an inner side of a machine room back cover.

In order to accomplish the above objects, according to an aspect of the present invention, there is provided a back cover integrated with a condenser for a refrigerator, which is provided outside a machine room of the refrigerator, for protecting the machine room containing a compressor for pressurizing coolant evaporated into a low-temperature low-pressure gaseous state by an evaporator into a high-temperature high-pressure gaseous state and a condenser connected to the compressor for condensing the coolant pressurized by the compressor into a high-temperature high-pressure liquid state, wherein said condenser is formed in integral with an inner side of said back cover.

Preferably, a heat area in which said condenser is contacted with air introduced from the external of said machine room is enlarged by increasing an area of said back cover integrated with said condenser so as to increase an amount of heat exchange of said condenser with the introduced air.

According to another aspect of the present invention, there is provided a machine room for a refrigerator, comprising a compressor for pressurizing coolant evaporated into a low-temperature low-pressure gaseous state by an evaporator into a high-temperature high-pressure gaseous state, a condenser connected to the compressor for condensing the coolant pressurized by the compressor into a high-temperature high-pressure liquid state, and a back cover provided outside said machine room for protecting said machine room within which said compressor and said condenser are provided, with said condenser formed in integral with an inner side of said back cover.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, a back cover integrated with a condenser for a refrigerator will be in detail described.

Figure 1:
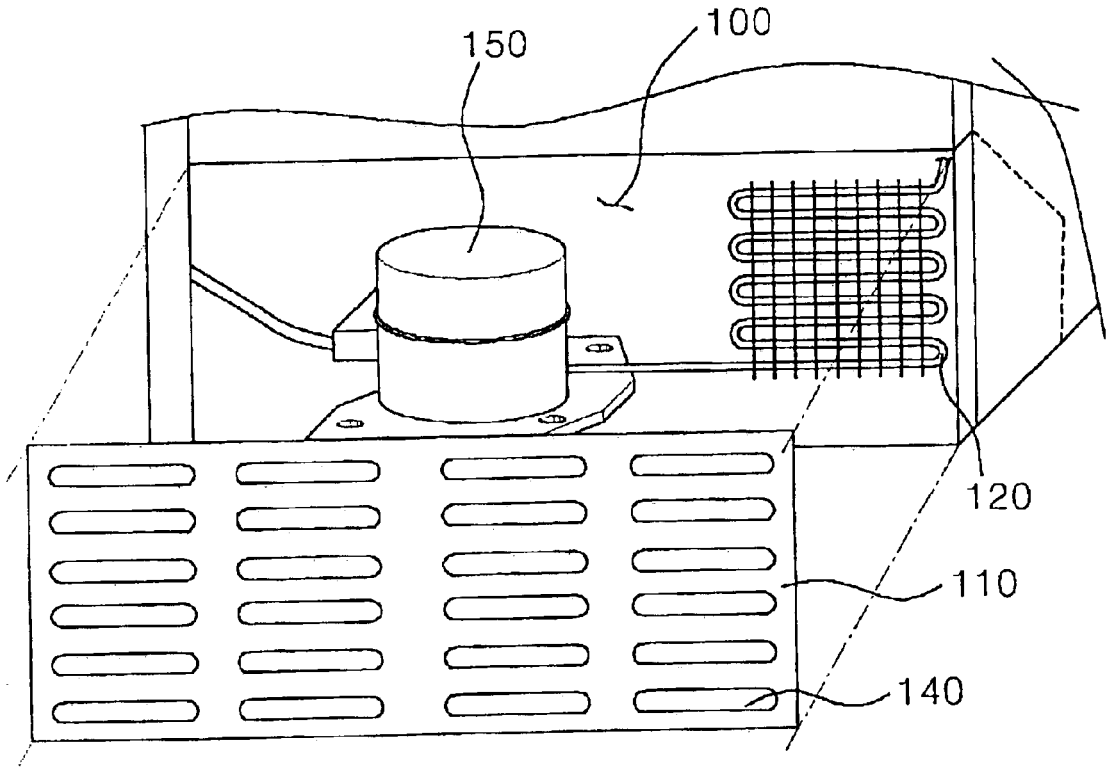
FIG. 1 (Related Art)
FIG. 1 is a partial perspective view illustrating a structure of a machine room of a conventional refrigerator.
Figure 2:
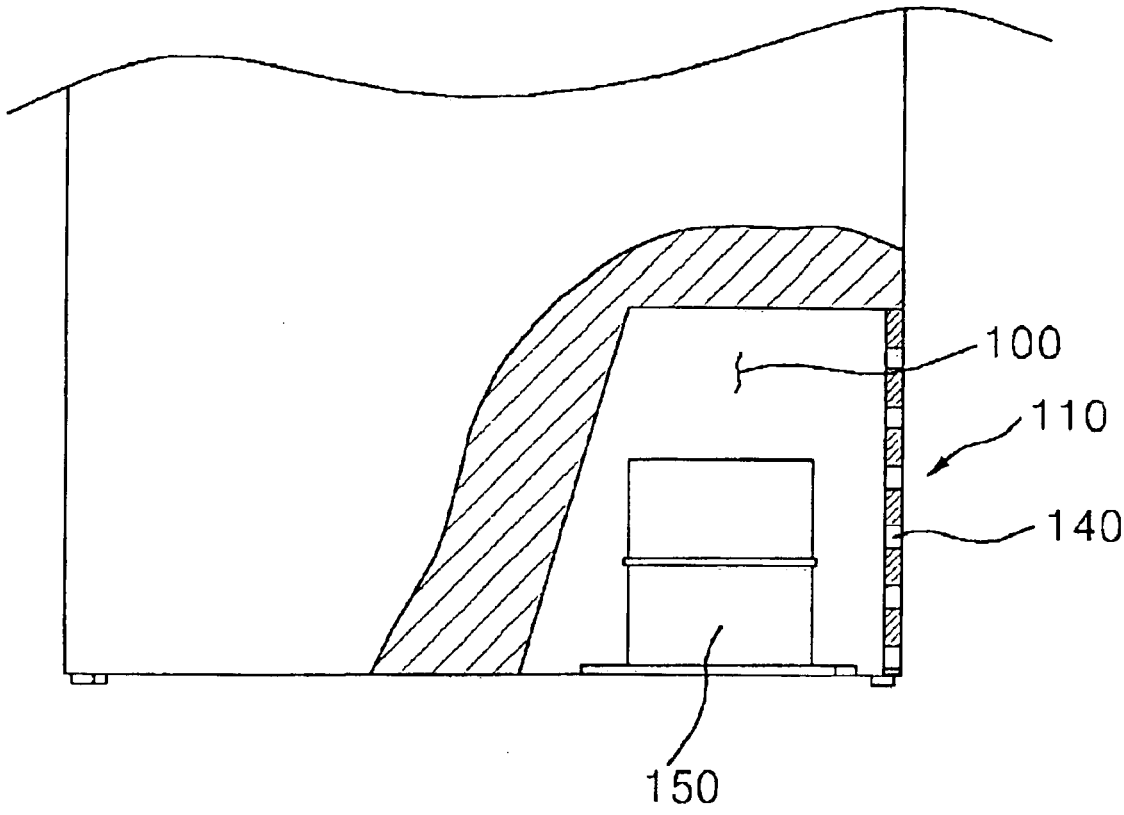
FIG. 2 (Related Art)
FIG. 2 is a partial side sectional view of the refrigerator at which a conventional machine room back cover is fixed.
Figure 3:
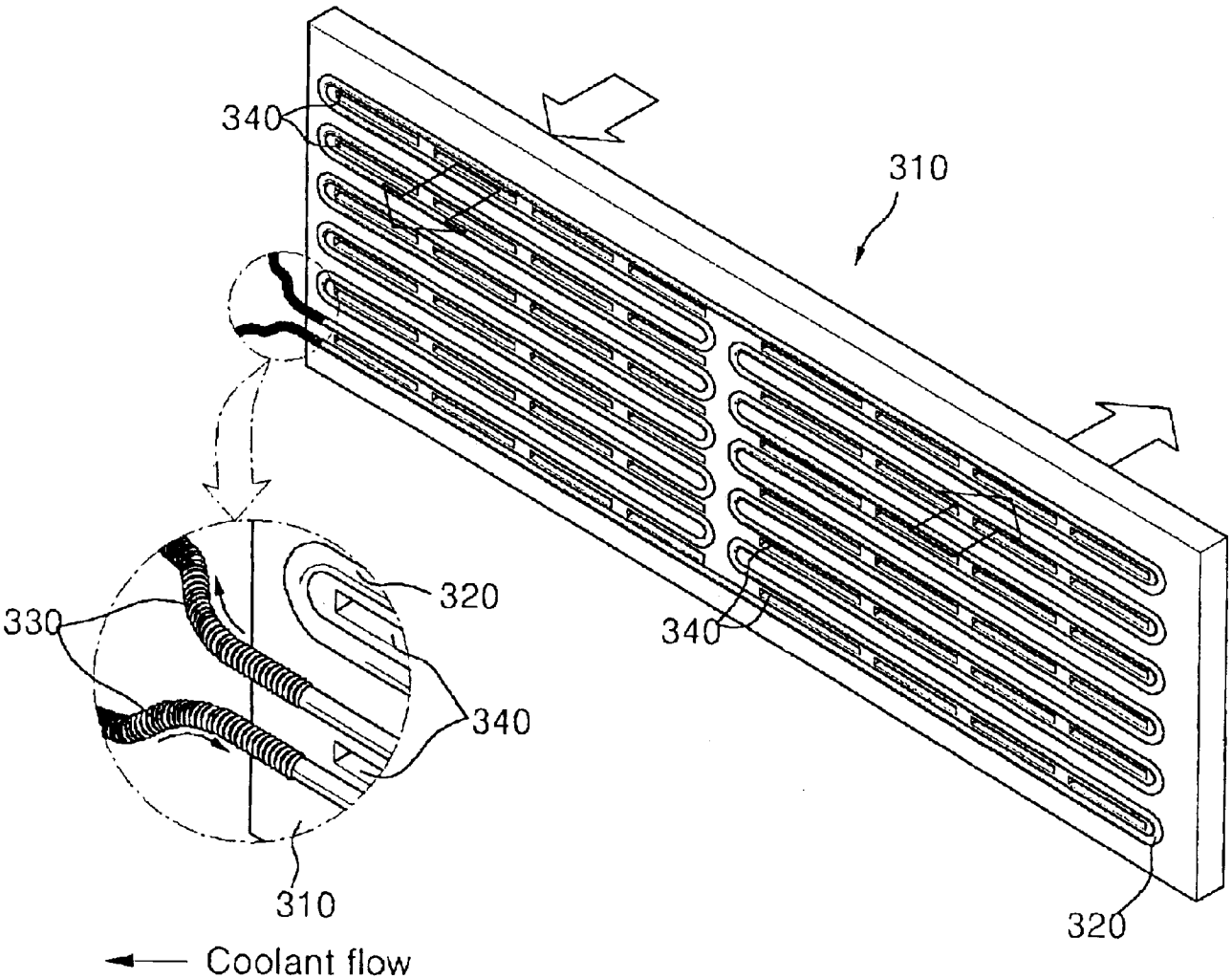
FIG. 3 is a perspective view of a machine room back cover integrated with a condenser according to the present invention.
Figure 4:
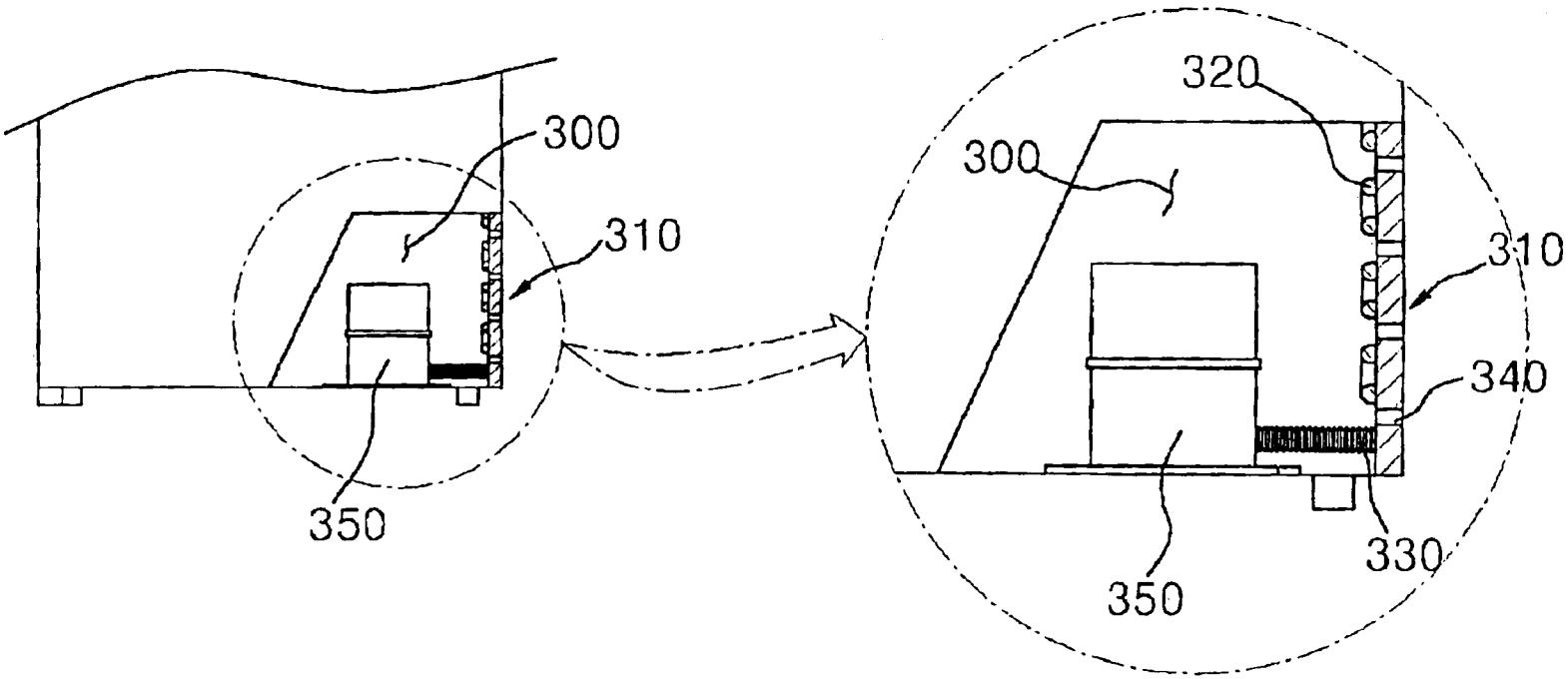
FIG. 4 is a partial side sectional view of the refrigerator at which a machine room back cover integrated with a condenser according to an embodiment of the present invention is fixed.

FIG. 3 is a perspective view of a machine room back cover integrated with a condenser according to the present invention, and FIG. 4 is a partial side sectional view of the refrigerator at which a machine room back cover integrated with a condenser according to an embodiment of the present invention is fixed.

Referring to FIGS. 3 and 4, a machine room 300 of the present invention positioned in a rear bottom portion of the refrigerator contains a compressor 350 for pressurizing coolant evaporated into a low-temperature low-pressure gaseous state by an evaporator into a high-temperature high-pressure gaseous state, a condenser 320 connected to the compressor 350 for condensing the coolant pressurized by the compressor 350 into a room-temperature high-pressure liquid state, and a machine room back cover 310 for protecting the compressor 350 and the condenser 320.

Here, differently from the conventional art, the machine room back cover 310 of the present invention is configured to form the condenser 320 integrally on an inner side of the machine room back cover 310 which is fixed outside the machine room 300 of the refrigerator and perform a function of a heat emission plate.

Such a structure of the machine room back cover 310 will be in detail described as follows.

As shown in FIGS. 3 and 4, in order to quickly emit internal heat of the machine room 300 (i.e., waste heat generated by the temperature of the compressor itself raised by load of a motor (not shown) of the compressor 350 when the low-temperature low-pressure coolant is pressurized into the high-temperature high-pressure state, and coolant heat emitted from the condenser 320) and the like out of the machine room 100, a plurality of vents 340 are formed between pipes of the condenser 320. Particularly, the machine room back cover 310 performs a function of a heat emission plate for emitting the heat emitted outside the pipes of the condenser 320 out of the machine room 300, i.e., out of the refrigerator while the coolant pressurized by the compressor 350 is condensed into the room-temperature high-pressure state by the condenser 320 which is formed in integral with the machine room back cover 310.

In addition, the condenser 320 is integrally formed on the inner side of the machine room back cover 310 such that a flow of air introduced from the external through the machine room back cover 310 is opposite to that of the coolant, that is, a counter flow is formed, and accordingly the heat efficiency of the refrigerator can be more improved.

Further, a connection pipe for connecting the condenser 320 formed in integral with the machine room back cover 310 with other elements (the compressor 350 and an expansion valve (not shown)) is formed as a creased pipe 330 which can be randomly varied in its extension and direction in order to provide an ease and simple open/close of the machine room back cover.

As a result, it is possible to repair the refrigerator without having to separate elements, which constitute a refrigeration cycle, including the condenser 320 formed in integral with the machine room back cover 310 from each other even when the machine room back cover 310 is opened for repairs of the refrigerator.

Figure 5:
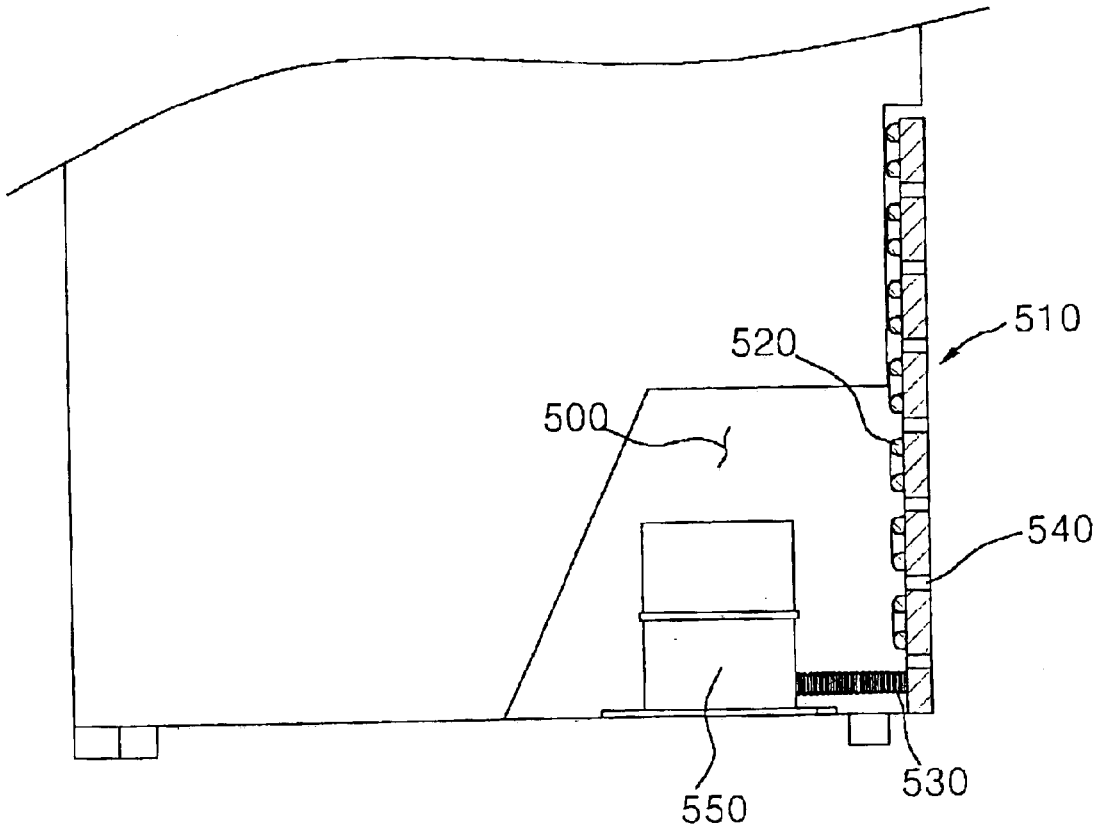
FIG. 5 is a partial side sectional view of the refrigerator at which a machine room back cover integrated with a condenser according to another embodiment of the present invention is fixed.

FIG. 5 is a partial side sectional view of the refrigerator at which a machine room back cover integrated with a condenser according to another embodiment of the present invention is fixed. It is shown in the figure that a heat area in which the condenser 520 is contacted with the air introduced from the external of the machine room is enlarged by increasing an area of the machine room back cover 510 integrated with the condenser 520 so as to increase an amount of heat exchange of the condenser 520 with the introduced air.

Basically, as the length of the condenser of the refrigeration cycle becomes increased, condensation temperature becomes lowered. This leads to good heat efficiency at the expense of the restraint of space and the increase of manufacture cost.

In order to overcome such a conflictive problem, in another embodiment of the present invention, the condenser is formed in integral with the machine room back cover, and simultaneously the length of the machine room back cover integrated with the condenser is increased toward a wall of the refrigerator which does not affect on an effective area of the refrigerator. Accordingly, the restraint of space can be mitigated and a heat area in which the condenser is contacted with the air introduced from the external of the machine room can be enlarged.

Particularly, the machine room back cover according to another embodiment of the present invention has one side (inner side) to which the pipe is attached and the other side (outer side) being a flat plate, both side being usable as the heat area. For the use of both side as the heat area, more than 10 mm distance is set between the machine room back cover and the wall so that a passage of air flow to enable a heat exchange is formed.

Figure 6:
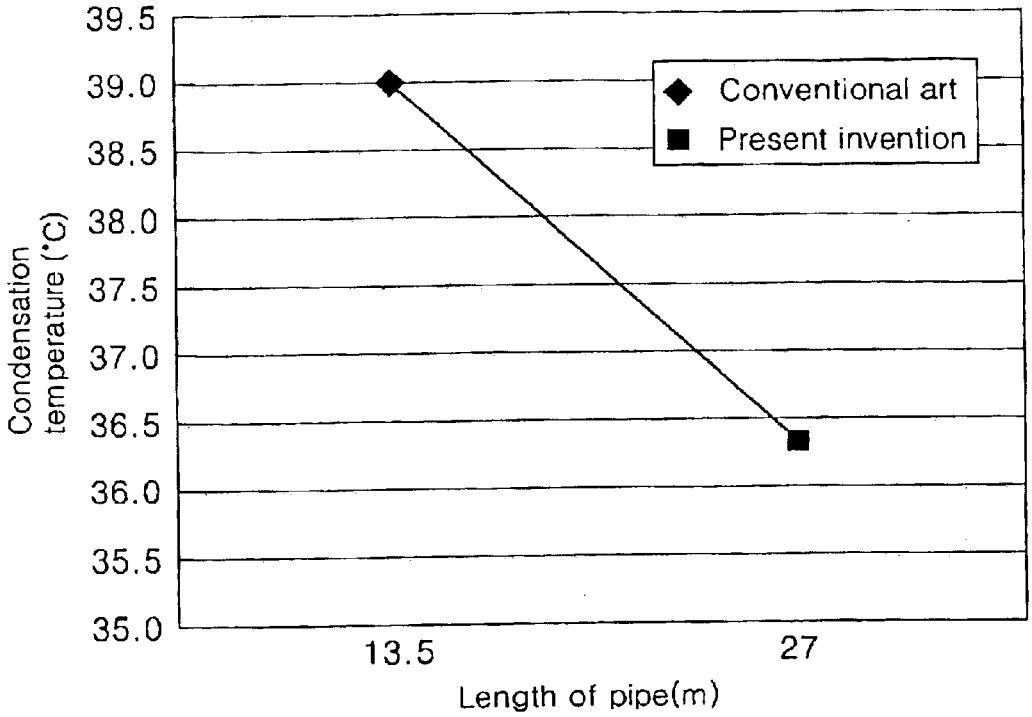
FIG. 6 is a graph showing an effect of performance improvement of a machine room back cover integrated with a condenser according to another embodiment of the present invention.

FIG. 6 is a graph showing an effect of performance improvement of a machine room back cover according to another embodiment of the present invention.

Referring to FIG. 6, it can be seen that the present invention (27 mm on the basis of the length of pipe) has an effect of lowering the condensation temperature by about 2.5° C. over the conventional art (13.5 mm on the basis of the length of pipe) in comparison of the performance of the condenser.

In addition, the present invention has also an effect of reducing energy consumption (Kwh/month) by 4%.

Now, the operation of the machine room back cover integrated with the condenser according to the present invention will be in detail described below.

Figure 7:
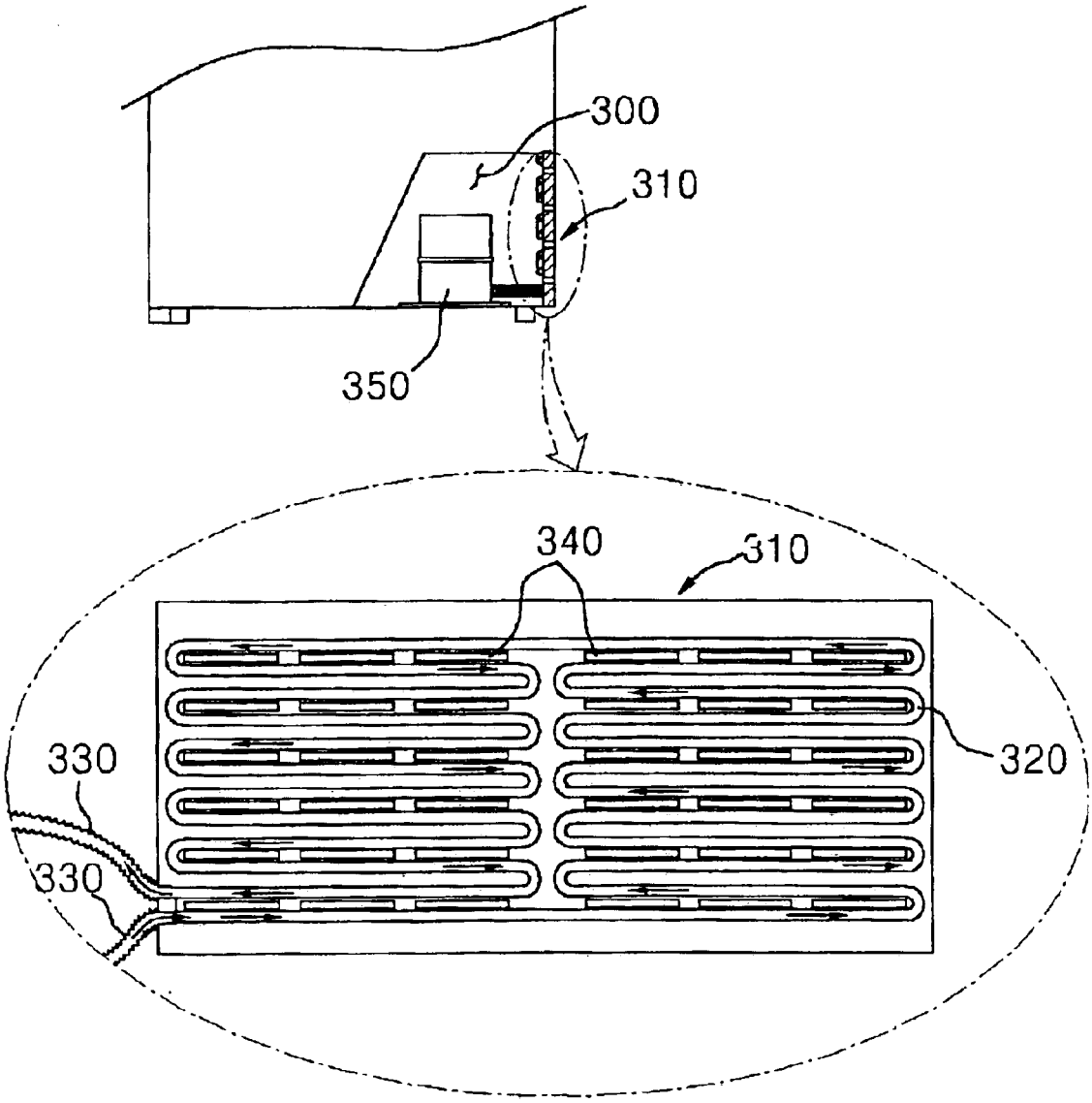
FIG. 7 is a view showing an operation state of a machine room back cover integrated with a condenser according to the present invention.

FIG. 7 is a view showing an operation state of a machine room back cover integrated with the condenser according to the present invention.

Firstly, during the refrigeration cycle of the refrigerator at which the machine room back cover 310 of the present invention is fixed, the coolant introduced into the compressor 350 through an evaporator (not shown) and then pressurized from a low-temperature low-pressure gaseous state into a high-temperature high-pressure gaseous state flows into the condenser 320 formed integrally on the inner side of the machine room back cover 310, as shown in FIG. 7. Then, the coolant introduced into the condenser 320 is changed into a room-temperature high-pressure liquid state by heat emission operation in the condenser 320. At that time, coolant heat emitted around the condenser 320 together with waste heat generated by the temperature of the compressor 350 itself raised by load of a motor of the compressor 350 when the coolant is pressurized by the compressor 350 is emitted out of the machine room 300, i.e., out of the refrigerator through the plurality of vents 340 of the machine room back cover 310 formed between the pipes of the condenser 320.

In addition, the machine room back cover 310 performs a function of a heat emission plate for emitting the coolant heat emitted around the condenser 320 out of the machine room 300, i.e., out of the refrigerator while the coolant pressurized by the compressor 350 is condensed into the room-temperature high-pressure state by the condenser 320 which is formed in integral with the machine room back cover 310.

The coolant changed into the room-temperature high-pressure state by the condensation in the condenser 320 as described above flows into an expansion valve (not shown). The coolant introduced into the expansion valve is depressurized into a state volatile by a heat exchange in the evaporator and then flows into the evaporator for performing evaporation process of the coolant.

In addition, the coolant introduced into the evaporator is changed into the low-temperature low-pressure state while being evaporated by an absorption reaction by which internal heat of the refrigerator is absorbed, and then introduced into the compressor 350 again to accomplish a complete refrigeration cycle. By discharging cold air produced by repeating such a refrigeration cycle into a cold-storage room in the refrigerator, the internal temperature of the refrigerator is lowered.

In addition, the condenser 320 formed in integral with the machine room back cover 310 is connected to other elements (the compressor 350 and the expansion valve) by the creased pipe 330 such that the refrigeration cycle constituted by other elements including the condenser 320 is discontinued. Accordingly, even when the machine room back cover 310 is opened for repairs of the refrigerator, as the creased pipe connecting the condenser 320 to the compressor 350 and the expansion valve is varied in its length and its direction, the condenser 320 formed in integral with the machine room back cover 310, the compressor 350 and the expansion valve are not separated from each other. Consequently, a failure of the refrigerator can be repaired without any discontinuity of the refrigeration cycle constituted by the compressor 350, the condenser 320, the expansion valve, the evaporator, etc.

As described above, according to the present invention, it is possible to protect a machine room and dissipate coolant heat emitted from a condenser outside a refrigerator, by integrally forming the condenser on an inner side of a machine room back cover provided outside the machine room of the refrigerator.

In addition, it is possible to repair the refrigerator without having to separate elements, which constitute a refrigeration cycle, including a condenser formed in integral with a machine room back cover from each other even when the machine room back cover is opened for repairs of the refrigerator, by forming a connection pipe for connecting the condenser to other elements so as to accomplish a complete refrigeration cycle as a creased pipe which can be randomly varied in its extension and direction.

Further, it is possible to save space within a machine room by the space within which a condenser was conventionally provided and utilize the saved space as internal space of a refrigerator, by integrally forming the condenser conventionally connected to a compressor in the machine room on an inner side of a machine room back cover.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A back cover for a refrigerator, the back cover comprising:

a back cover plate configured to be positioned outside a machine room of the refrigerator, the machine room containing a compressor and a condenser connected to the compressor, wherein the condenser is formed as a single unit with the back cover, and wherein an outer wall of the condenser is configured to form a machine room cover portion of the back cover.

2. The back cover according to claim 1, wherein the condenser is configured such that a flow of air introduced from an external source through the back cover is opposite to a flow of a coolant in the condenser so as to form a counter flow.

3. The back cover according to claim 1, wherein a plurality of vents are formed in the back cover between pipes of the condenser.

4. The back cover according to claim 1, further comprising a creased pipe configured to connect the condenser to other elements of the refrigerator and configured to be randomly varied in its extension and direction.

5. A back cover for a refrigerator, the back cover comprising:

a back covet plate configured to be positioned outside a machine room of the refrigerator, the machine room containing a compressor and a condenser connected to the compressor, wherein the condenser is formed as a single unit with the back covers and wherein both inner and outer sides of the back cover are configured to serve as a heat emission plate of the condenser, and wherein a heat area portion of the back cover is configured to allow the condenser contact with external air wherein the heat area portion of the back cover comprises a portion of the back cover with the integral condenser which is greater than an opening area of the machine room.

6. The back cover according to claim 5, wherein the condenser is configured such that a flow of air introduced from the external source through the back cover is opposite to a flow of a coolant in the condenser, so as to form a counter flow.

7. The back cover according to claim 5, wherein a plurality of vents are formed in the back cover between pipes of the condenser.

8. The back cover according to claim 5, further comprising a creased pipe configured to connect the condenser to other elements of the refrigerator and configured to be randomly varied in its extension and direction.

9. The back cover according to claim 5, wherein a distance between the back cover and a wall of the refrigerator is greater than 10 mm.

10. A machine room for a refrigerator, comprising:

a compressor configured to pressurize coolant evaporated into a low-temperature low-pressure gaseous state by an evaporator into a high-temperature high-pressure gaseous state;

a condenser connected to the compressor and configured to condense the coolant pressurized by the compressor into a high-temperature high-pressure liquid state; and a back cover provided outside the machine room and configured to protect the machine room, wherein the condenser is formed as a single unit with the back cover, and wherein an outer wall of the condenser is configured to form a machine room cover portion of the back cover.

11. The machine room according to claim 10, wherein the condenser is configured such that a flow of air introduced from an external source through the back cover is opposite to a flow of a coolant in the condenser, so as to form a counter flow.

12. The machine room according to claim 10, wherein a plurality of vents are formed in the back cover between pipes of the condenser.

13. The machine room according to claim 10, further comprising a creased pipe configured to connect the condenser to other elements of the refrigerator and configured to be randomly varied in its extension and direction.

14. The machine room according to claim 10, wherein the back cover further comprises a heat area configured so as to allow the condenser contact with air introduced from a source external to the machine room, and wherein the heat area is enlarged by increasing an area of said back cover integral with the condenser.

15. The machine room according to claim 14, wherein a distance between the back cover and a wall of the refrigerator is greater than 10 mm.

16. A refrigerator comprising the back cover of claim 1.

17. A refrigerator comprising the back cover of claim 5.

18. A refrigerator comprising the machine room of claim 10.

19. The back cover according to claim 1, wherein the condenser and back cover are molded as a single unit from the same material.

20. The back cover according to claim 1, wherein a height of the machine room cover portion of the back cover is greater than a height of the machine room.

21. The back cover according to claim 1, wherein both inner and outer sides of the back cover are configured to serve as a heat emission plate of the condenser.

22. The back cover according to claim 5, wherein a height of the machine room cover portion of the back cover is greater than a height of the machine room.

23. The back cover according claim 5, wherein an outer wall of the condenser is configured to form a machine room cover portion of the back cover.

24. The machine room according to claim 10, wherein the condenser and back cover are a single integrated unit so as to allow both inner and outer sides of the back cover to serve as a heat emission plate of the condenser, and when a height of the machine room cover portion of the back cover is greater than a height of the machine room so as to increase a capacity associated with the condenser.

* * * * *